United States Patent [19]

Bernier

[11] 4,328,476

[45] May 4, 1982

[54] ELECTROMAGNETIC RELAY HAVING TWO SYNCHRONIZED ARMATURES

[76] Inventor: Raymond Bernier, 29 Ave. Foch, 94300 Vincennes, France

[21] Appl. No.: 217,184

[22] Filed: Dec. 16, 1980

[30] Foreign Application Priority Data

Feb. 12, 1980 [FR] France ..... 80 03054

[51] Int. Cl.[3] ..... H01H 9/24

[52] U.S. Cl. ..... 335/128; 335/161; 335/203

[58] Field of Search ..... 335/160, 161, 162, 163, 335/203, 120, 119, 128, 233, 265, 136

[56] References Cited

U.S. PATENT DOCUMENTS

| | | | |
|---|---|---|---|
| 1,819,061 | 8/1931 | Bancroft | 335/160 |
| 2,284,755 | 6/1942 | Melick | 335/233 X |
| 2,402,722 | 6/1946 | Bean et al. | 335/265 X |
| 2,876,292 | 3/1959 | Callender et al. | 335/119 X |

*Primary Examiner*—L. T. Hix
*Assistant Examiner*—S. D. Schreyer
*Attorney, Agent, or Firm*—Young & Thompson

[57] ABSTRACT

An electromagnetic relay mounted within a casing comprises a coil provided with an axial core forming a magnetic circuit with a yoke and two L-shaped armatures. A first arm of each armature consists of a magnetic plate while a second arm serves to actuate movable contacts. The ends of the second arms cooperate with each other by interengagement of lugs so as to ensure synchronous operation of the armatures.

5 Claims, 4 Drawing Figures

ELECTROMAGNETIC RELAY HAVING TWO SYNCHRONIZED ARMATURES

This invention relates to an electomagnetic relay having two armatures, of the type comprising a coil provided with an axial core forming a magnetic circuit with a yoke disposed in parallel relation to the coil and with the two relay armatures, said armatures being each adapted to cooperate with one end of the core in order to actuate separate movable contacts.

The design function of known relays of this type is to actuate two contacts simultaneously by means of a single excitation of the coil. In practice, however, this simultaneous action is liable to be affected by any constructional dissymmetry of the relay which may be of either a mechanical, electrical or magnetic character, especially if the coil has an elongated shape and if the coil excitation voltage is established progressively.

It has been endeavored to improve the synchronization of motion of the armatures by placing a system of articulated link-rods between said armatures. A system of this type, however, is both costly and unreliable.

The aim of the present invention is to provide a relay in which synchronization of motion of the armatures is not subject to any potential danger of failure.

In accordance with the invention, the electromagnetic relay is placed within a casing and comprises a coil provided with an axial core forming a magnetic circuit with a yoke disposed in parallel relation to the coil and with two movable magnetic armatures each adapted to cooperate with one end of the core, each armature being adapted to actuate at least one movable contact which cooperates with at least one stationary contact. Said relay is distinguished by the fact that each armature is designed substantially in the shape of an "L", a first arm of said "L" being constituted by a magnetic armature plate located transversely with respect to the coil and the second arm of said "L" being adapted to extend along the yoke, and that cooperating means are provided at the respective ends of the two second arms in order to ensure that any movement of one armature is imparted to the other armature.

The mechanical linkage thus provided between the armatures is such that, as soon as one armature begins to move under the action of its force of magnetic attraction or restoring force, part of this force is transmitted to the other armature and added to the inherent force which produces action on said other armature. Practically perfect simultaneity of actuation of the contacts is thus achieved.

In a first alternative embodiment of the invention, each armature is provided at the end of its second arm with lugs engaged in complementary lugs of the second arm of the other armature.

By virtue of their interengagement, the lugs just mentioned provide an excellent means of mechanical cooperation between the armatures.

Preferably, the interengagement aforesaid affords a predetermined clearance which permits relative angular displacement of the armatures.

In a second alternative embodiment of the invention, the armatures are joined together at the free ends of their second arms so as to form a single part, said part being made of flexible material at least within the junction zone.

The material must be sufficiently flexible to be capable of stretching to a slight extent during rotational motion of the two armatures and also of bending under the action of the combined pivotal movements of said armatures.

In a preferred embodiment of the invention, the armatures comprise a portion of plastic material overmolded on two magnetic plates.

This embodiment makes it possible to obtain a sharp internal angle which accurately defines the axis of rotation without any need to depend on the radius of curvature of a bent-back armature.

These and other features of the invention will be more apparent upon consideration of the following description and accompanying drawings which are given by way of example and not in any limiting sense, and in which.

Figure 1:
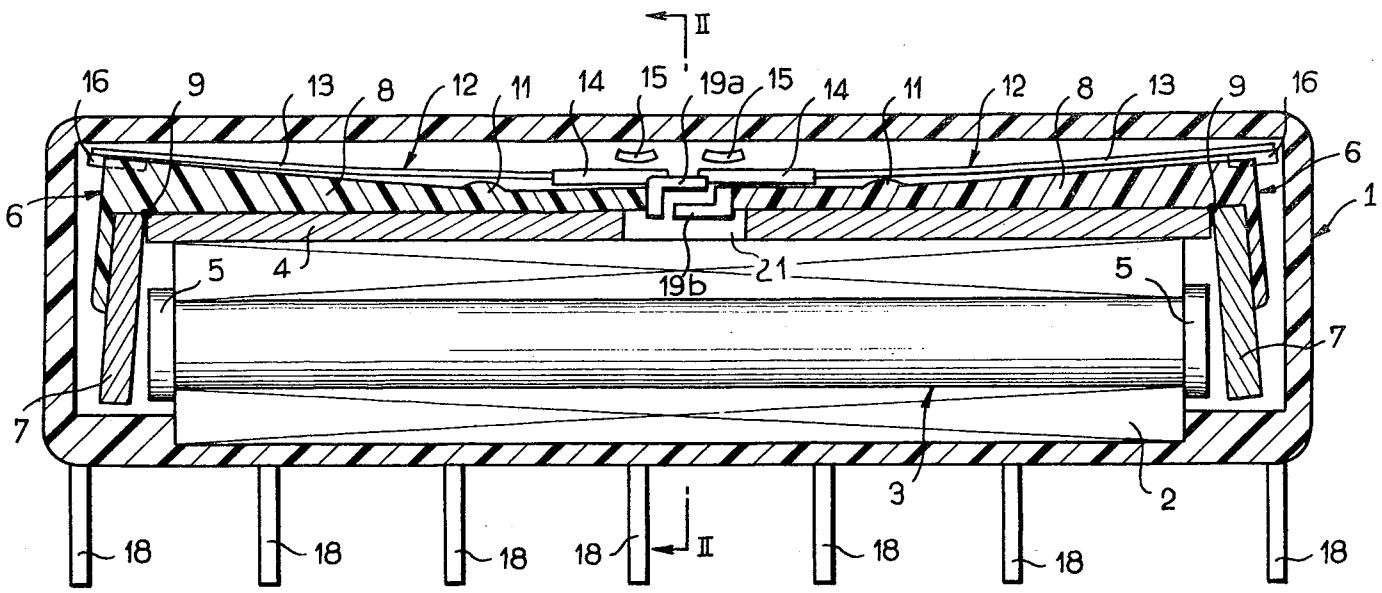
FIG. 1 is a longitudinal sectional view of a relay in accordance with a first alternative embodiment of the invention, this view being taken along line I—I of FIG. 2.
Figure 3:
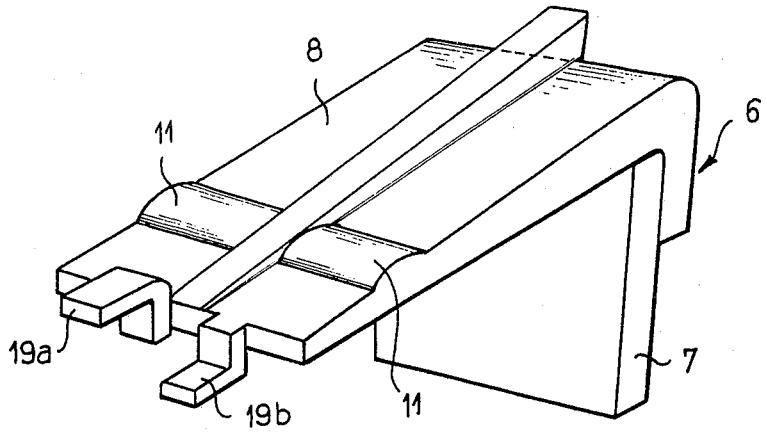
FIG. 3 is a view in perspective of an armature of the relay shown in FIGS. 1 and 2.
Figure 2:
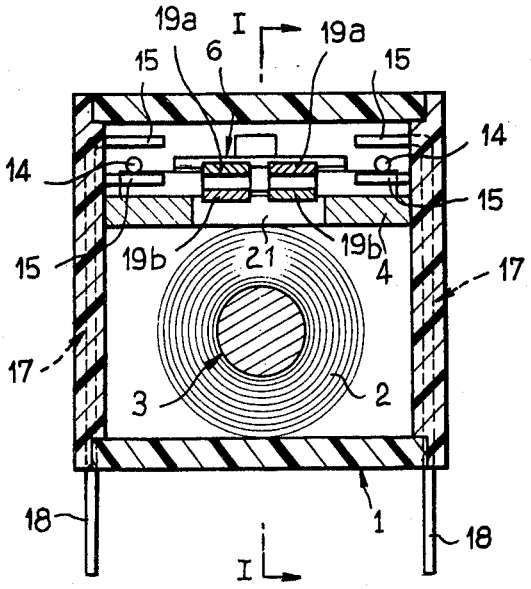
FIG. 2 is a cross-sectional view taken along line II—II of FIG. 1.

Referring to FIGS. 1 to 3, the relay in accordance with the invention comprises, within a casing 1 of plastic material, a coil 2 provided with an axial core 3 forming a magnetic circuit with a yoke 4 located externally with respect to the coil 2. The core 3 is provided at each end with projecting pole-pieces 5 which are intended to cooperate with symmetrically arranged L-shaped armatures 6. A first arm of each armature is constituted by a magnetic plate 7 arranged transversely with respect to the coil and overmolded within a second arm 8 of non-magnetic material which extends along the yoke.

The arrangement of the armatures is such as to permit of pivotal motion of these latter about a point 9 located at the root of the L and at the end of the yoke 4.

The second arm 8 of the armature is provided with bosses 11 formed on its external surface in order to cooperate with two movable contacts 12 each constituted by a flexible strip 13, the end of which is adapted to carry a contact member 14.

The relay is therefore provided with two pairs of movable contacts 12 each disposed in cooperating relation with a pair of stationary contacts 15. Both the stationary contacts and the stationary supports 16 of the flexible strips 13 are constituted by bent-back end portions 17 of conductive rods which are embedded within the walls of the casing 1 (as shown in FIG. 2) and pass out of the lower end of the relay so as to constitute connections 18 which include the leads of the coil 2.

Each armature 6 is provided at the end of its second arm 8 with two lugs 19*a*, 19*b* which serve substantially as extensions of said second arm and are located at different levels. The lug 19*a* is located at an upper level and the lug 19*b* is located at a lower level.

Since the two armatures 6 are identical and disposed in top-to-tail relation within the relay, the lug 19*a* of one armature will be located opposite to the lug 19*b* of the other armature, and conversely.

When the armatures are mounted in position, the projecting lower end of each lug is housed within a cavity 21 formed in the yoke 4.

The levels of the above-mentioned lugs with respect to the armature which carries these latter are so determined as to permit interengagement of said lugs with a slight transverse clearance which permits relative angular displacement of the armatures during operation of the relay.

Similarly, the length of the lugs is determined in relation to the length of the second arms 8 of the armatures so as to provide a slight longitudinal clearance which also permits said relative angular displacement.

Under operating conditions and when the coil is either energized or de-energized, if the movement of one armature 6 has a tendency to start before the movement of the other and to take place at a higher speed, it is apparent that the presence of the lugs 19 produces a braking action on the armature whose movement is too fast and an accelerating action on the armature whose movement is too slow in order to synchronize the two movements. Overlapping between the normally-open and normally-closed contacts is thus prevented.

The invention thus makes provision for four change-over contacts having synchronized operation.

Figure 4:
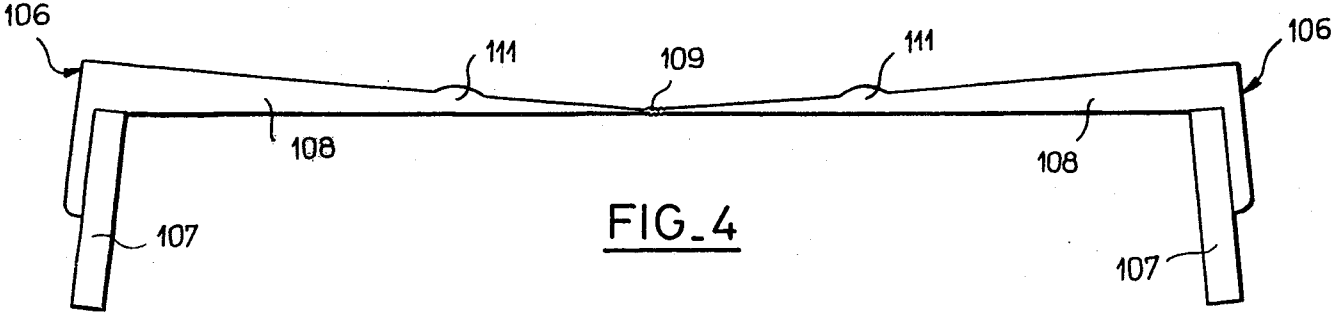
FIG. 4 is a side view of the armatures in a second alternative embodiment.

Referring to FIG. 4, another embodiment of the invention will now be described.

In this embodiment, the armatures 106 are joined together at the ends of their second arms 108 so as to form a one-piece component. To be more precise, the portions of plastic material of said armatures are thus joined together whereas the overmolded armature plates 107 remain separate.

The second arms 108 progressively decrease in thickness towards the point of junction 109 which is designed in the form of a very thin plastic web having practically zero bending resistance. Furthermore, the plastic material employed is capable of stretching to a slight extent at the point of minimum thickness in order to produce an action which is equivalent to longitudinal play.

This embodiment is more simple to construct but calls for the use of plastic material having the necessary properties of flexibility.

Practically perfect synchronism of motion of the armatures is obtained in all cases, thus achieving the general aim of the invention.

As will readily be apparent, the invention is not limited to the examples described in the foregoing but extends to any technological alternative within the capacity of those versed in the art. By way of example, each magnetic armature plate 7 may be adapted to carry movable contacts 12 which are so arranged as to be parallel to said plate 7.

What is claimed is:

1. An electromagnetic relay placed within a casing and comprising a coil provided with an axial core forming a magnetic circuit with a yoke disposed in parallel relation to the coil and with two movable magnetic armatures each adapted to cooperate with one end of the core, each armature being adapted to actuate at least one movable contact which cooperates with at least one stationary contact, wherein each armature is designed substantially in the shape of an "L", a first arm of said "L" being constituted by a magnetic armature plate located transversely with respect to the coil and the second arm of said "L" being adapted to extend along the yoke, and wherein cooperating means are provided at the respective ends of the two second arms in order to ensure that any movement of one armature is imparted to the other armature.

2. A relay according to claim 1, wherein each armature is provided at the end of the second arm thereof with lugs engaged in complementary lugs of the second arm of the other armature.

3. A relay according to claim 2, wherein the interengagement aforesaid affords a predetermined clearance which permits relative angular displacement of the armatures.

4. A relay according to claim 1, wherein the armatures are joined together at the free ends of the second arms thereof so as to form a single part, said part being made of flexible material at least within the junction zone.

5. A relay according to claim 1, wherein the armatures each have a portion of plastic material overmolded on two magnetic plates.

* * * * *